US010618107B2

(12) United States Patent
Brown et al.

(10) Patent No.: US 10,618,107 B2
(45) Date of Patent: Apr. 14, 2020

(54) VARIABLE THICKNESS CONTINUOUS CASTING FOR TAILOR ROLLING

(71) Applicant: GM Global Technology Operations LLC, Detroit, MI (US)

(72) Inventors: Tyson W. Brown, Royal Oak, MI (US); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 231 days.

(21) Appl. No.: 15/098,712

(22) Filed: Apr. 14, 2016

(65) Prior Publication Data

US 2017/0297092 A1 Oct. 19, 2017

(51) Int. Cl.
*B22D 11/12* (2006.01)
*B21B 1/12* (2006.01)
(Continued)

(52) U.S. Cl.
CPC ..... *B22D 11/1206* (2013.01); *B21B 1/12* (2013.01); *B21B 1/463* (2013.01); *B21B 3/02* (2013.01); *B22D 11/009* (2013.01); *B22D 11/0622* (2013.01); *B22D 11/124* (2013.01); *B22D 11/126* (2013.01); *C21D 8/021* (2013.01);
(Continued)

(58) Field of Classification Search
CPC ..... B22D 11/009
See application file for complete search history.

(56) References Cited

U.S. PATENT DOCUMENTS 342,920 A 6/1886 Matthes et al.
3,251,213 A * 5/1966 Noda ..... B21B 1/088 72/225
(Continued)

FOREIGN PATENT DOCUMENTS

CN 1066353 C 5/2001
CN 1872492 A 12/2006
(Continued)

OTHER PUBLICATIONS

CN 101664879 machine translation (Year: 2010).*
(Continued)

*Primary Examiner* — Paul A Wartalowicz
*Assistant Examiner* — Stephani Hill
(74) *Attorney, Agent, or Firm* — Harness, Dickey & Pierce, P.L.C.

(57) ABSTRACT

Methods of forming a high-strength metal alloy precursor by tailor-casting strips having a tailored thickness across a width of a strip material are provided. The tailor-cast strips have varying thickness throughout the width, which can then be further tailor rolled to a final required thickness profile/tailored thickness. Such tailor-casting method can be conducted by contacting a patterned surface of a casting roller or a casting block with a liquid high-strength metal alloy in a continuous casting process. The present disclosure provides methods of continuously casting a strip having varying thickness across the width allows for improved product in subsequent processing, like tailor rolling. Methods of making a high-strength metal alloy structural automotive component from a tailor-cast blank having a tailored thickness are also provided.

18 Claims, 5 Drawing Sheets

(51) Int. Cl.

| | |
|---|---|
| ***B21B 1/46*** | (2006.01) |
| ***B21B 3/02*** | (2006.01) |
| ***B22D 11/06*** | (2006.01) |
| ***B22D 11/124*** | (2006.01) |
| ***B22D 11/126*** | (2006.01) |
| ***C21D 8/02*** | (2006.01) |
| ***B22D 11/00*** | (2006.01) |

(52) U.S. Cl.
CPC ..... *C21D 8/0205* (2013.01); *C21D 8/0221* (2013.01); *C21D 8/0247* (2013.01)

(56) References Cited

U.S. PATENT DOCUMENTS

| | | | | |
|---|---|---|---|---|
| 3,342,251 | A | 9/1967 | Nagin et al. | |
| 3,944,782 | A * | 3/1976 | Metcalfe | B21B 45/004 219/152 |
| 4,682,646 | A | 7/1987 | Hulek | |
| 5,036,902 | A * | 8/1991 | Streubel | B22D 11/009 164/491 |
| 5,386,869 | A * | 2/1995 | Wilde | B21B 1/088 164/491 |
| 5,623,845 | A * | 4/1997 | Wilde | B21B 1/088 72/225 |
| 5,948,185 | A | 9/1999 | Krajewski et al. | |
| 6,045,636 | A | 4/2000 | Krajewski | |
| 6,092,586 | A | 7/2000 | Schonbeck | |
| 6,488,790 | B1 * | 12/2002 | Hartmann | C21D 8/0226 148/602 |
| 6,536,254 | B1 | 3/2003 | Kawalla et al. | |
| 6,811,625 | B2 | 11/2004 | Verma | |
| 6,820,680 | B1 | 11/2004 | Fukase et al. | |
| 7,156,153 | B2 | 1/2007 | Hohenbichler et al. | |
| 7,216,927 | B2 | 5/2007 | Luo et al. | |
| 7,913,744 | B1 | 3/2011 | Marti et al. | |
| 7,950,124 | B2 | 5/2011 | Stuth | |
| 7,963,136 | B2 | 6/2011 | Flick et al. | |
| 7,967,928 | B2 | 6/2011 | Luo et al. | |
| 8,163,113 | B2 | 4/2012 | Mishra et al. | |
| 8,287,966 | B2 | 10/2012 | Sundarraj et al. | |
| 8,327,910 | B2 | 12/2012 | Walker et al. | |
| 8,327,918 | B2 | 12/2012 | Seidel et al. | |
| 8,361,251 | B2 | 1/2013 | Luo et al. | |
| 8,365,806 | B2 | 2/2013 | Rosenthal et al. | |
| 8,708,425 | B2 | 4/2014 | Carlson et al. | |
| 8,783,332 | B2 | 7/2014 | Gruss | |
| 8,852,359 | B2 | 10/2014 | Walker et al. | |
| 8,889,226 | B2 | 11/2014 | Walker et al. | |
| 8,960,264 | B2 | 2/2015 | Mahapatra et al. | |
| 8,960,265 | B2 | 2/2015 | Mahapatra et al. | |
| 9,126,247 | B2 | 9/2015 | Kim | |
| 9,481,034 | B2 | 11/2016 | Chen et al. | |
| 2005/0194072 | A1 | 9/2005 | Luo et al. | |
| 2007/0012573 | A1 | 1/2007 | Sawada et al. | |
| 2007/0269337 | A1 | 11/2007 | Luo et al. | |
| 2008/0096039 | A1 | 4/2008 | Sachdev et al. | |
| 2008/0223100 | A1 | 9/2008 | Verloop et al. | |
| 2009/0071620 | A1 | 3/2009 | Bharadwaj et al. | |
| 2009/0139290 | A1 | 6/2009 | Britanik et al. | |
| 2011/0286880 | A1 | 11/2011 | Luo et al. | |
| 2012/0273539 | A1 | 11/2012 | Carter | |
| 2012/0301669 | A1 | 11/2012 | Walker et al. | |
| 2013/0139992 | A1 | 6/2013 | Winter | |
| 2014/0017115 | A1 | 1/2014 | Wang et al. | |
| 2014/0150985 | A1 | 6/2014 | Carlson et al. | |
| 2014/0290894 | A1 | 10/2014 | Chen et al. | |
| 2015/0079440 | A1 | 3/2015 | Reich | |
| 2015/0239039 | A1 | 8/2015 | Klos et al. | |
| 2016/0375473 | A1 * | 12/2016 | Champion | B22D 11/009 428/600 |

FOREIGN PATENT DOCUMENTS

| | | | | |
|---|---|---|---|---|
| CN | 1966204 | A | 5/2007 | |
| CN | 101664879 | A * | 3/2010 | |
| CN | 103774041 | A | 5/2014 | |
| CN | 103883867 | A | 6/2014 | |
| CN | 105312520 | A | 2/2016 | |
| CN | 107297474 | A | 10/2017 | |
| DE | 3411734 | A1 | 11/1985 | |
| DE | 3634368 | A | 4/1988 | |
| DE | 19903928 | A1 | 5/2000 | |
| DE | 10057876 | C1 | 5/2002 | |
| DE | 10216141 | A1 | 10/2003 | |
| DE | 102004046249 | A1 | 6/2006 | |
| DE | 102005031461 | A1 | 1/2007 | |
| DE | 102010049205 | A1 | 4/2012 | |
| DE | 102010055444 | A1 | 6/2012 | |
| DE | 102017107746 | A1 | 10/2017 | |
| EP | 1050355 | A2 | 11/2000 | |
| EP | 1243362 | A2 | 9/2002 | |
| EP | 2357051 | A1 | 8/2011 | |
| GB | 408820 | A | 4/1934 | |
| GB | 2105229 | A | 3/1983 | |
| JP | S5850164 | A | 3/1983 | |
| JP | S60238067 | A | 11/1985 | |
| JP | H11-192502 | * | 7/1999 | |
| JP | 2010105026 | A * | 5/2010 | |
| KR | 20170117875 | A | 10/2017 | |
| WO | 9633826 | A1 | 10/1996 | |
| WO | WO-1999047293 | A1 | 9/1999 | |
| WO | WO-2015117696 | A1 * | 8/2015 | B22D 11/009 |

OTHER PUBLICATIONS

JP 2010-105026 machine translation (Year: 2010).*
DE 3411734 machine translation (Year: 1985).*
Hirt et al. "Tailored profiles made of tailor rolled strips by roll forming—Part 1 or 2" Steel Research Int. 83 (2012) No. 1 pp. 100-105. (Year: 2012).*
JP H11-192502 machine translation (Year: 1999).*
Dr. -Ing. Michael Rehse; "Flexible Rolling of Tailor Rolled Blanks—innovative light weight design in steel-"; http://www.autosteel.org/~/media/Files/Autosteel/Great%20Designs%20in%20Steel/GDIS%202006/14%20-%20Flexible%20Rolling%20of%20Tailor%20Rolled%20Blanks.pdf; downloaded Oct. 25, 2016; 27 pages.
Paul Weissler; "Focus B-pillar 'tailor rolled' to 8 different thicknesses"; http://articles.sae.org/7695/; February 24, 2010; 2 pages.
First Office Action for Chinese Patent Application No. 201710212427.1 dated Oct. 22, 2018 and correspondence dated Oct. 24, 2018 from China Patent Agent (H.K.) Ltd. summarizing contents, 9 pages.
Second Office Action for corresponding Chinese Patent Application No. 201710212427.1 dated Jul. 1, 2019 with English language machine translation, 16 pages.
Third Office Action for Chinese Patent Application No. 201710212427.1 dated Nov. 19, 2019 with English language machine translation, 22 pages.

* cited by examiner

VARIABLE THICKNESS CONTINUOUS CASTING FOR TAILOR ROLLING

FIELD

The present disclosure relates to variable thickness continuous casting for tailor rolling.

BACKGROUND

This section provides background information related to the present disclosure which is not necessarily prior art.

Different techniques have been used in various manufacturing processes, such as manufacturing in the automobile industry, to reduce the weight of a vehicle, while still maintaining its structural integrity. For example, tailor-rolled blanks are commonly used to form structural components for vehicles that need to fulfill specialized load requirements. A sheet metal panel or blank may be rolled to predetermined thicknesses and then roll formed or stamped by being pressed between a pair of dies to create a complex three-dimensional shaped component. The sheet metal material is chosen for its desirable characteristics, such as strength, ductility, and other properties related to the metal alloy. For example, the B-pillar structural component of a car body desirably exhibits a relatively high structural rigidity in the areas corresponding to the body of the occupant, while having increased deformability in the lower region at or below the occupant's seat to facilitate buckling of the B-pillar below seat level when force or impact is applied. As the structural component has different performance requirements in different regions, such a component can be made with multiple distinct pieces assembled together or from a single piece having different thicknesses.

Tailor rolled blanks can form such structural components having different thicknesses and therefore different mechanical properties along the panel or blank. Tailor rolled blanks have an advantage over alternatives like tailor-welded assemblies (where different pieces are welded together), in that they do not have welds or seams that can introduce potential weak regions or areas where corrosion could occur. Furthermore, many more transitions or stepped changes in thicknesses may be provided in a tailor rolled blank than a tailor-welded blank assembly, providing more design flexibility. By way of non-limiting example, tailor rolled blank assemblies may be used to form structural components in vehicles, for example, rocker rails, structural pillars (such as A-pillars, B-pillars, C-pillars, and/or D-pillars), hinge pillars, vehicle doors, roofs, hoods, trunk lids, engine rails, and other components with high strength requirements.

In a typical simplified process for forming tailor rolled blanks, a metal sheet or strip can undergo a rolling process that creates different thicknesses along the length of the sheet or strip. Prior to tailoring rolling, the metal sheet or strip material is cast, treated as necessary, cooled, and then rolled into an elongated sheet or strip having a uniform thickness, which then is rolled into a coil. Subsequently, the sheet material is uncoiled, typically at another processing facility, and subjected to a tailor blank rolling process. The sheet passes between one or more cold rolling stations, where different thicknesses may be produced along a length of the strip as it passes by rollers. However, in conventional processes, the thickness remains constant laterally or widthwise across the strip and only varies along a length of the strip. Any changes in thickness are formed in the sheet material lengthwise by changing and controlling a gap between rollers as the sheet material passes or rolls through.

Such changes in the gap are typically achieved where the tailor rollers oscillated. Such systems require dynamic and precision control of the rollers to control the gap height and often cannot provide smooth, short transitions between distinct thicknesses. Furthermore, the dynamic control roller systems and processes are quite costly.

It would be desirable to develop alternative new methods for forming structural components that are required to exhibit variable properties in different regions, such as tailor rolled blanks, where such new processes provide superior control over thickness transitions, including an ability to tightly control thicknesses widthwise across a sheet or strip. Further, it would be desirable to form tailor rolled blanks via a process that is less expensive while having improved tailor rolled blank quality.

SUMMARY

This section provides a general summary of the disclosure, and is not a comprehensive disclosure of its full scope or all of its features.

In certain aspects, the present disclosure provides a method of forming a high-strength metal alloy precursor having a tailored thickness. The method optionally comprises contacting a patterned surface of a casting roller or a casting block with a liquid metal, such as a liquid high-strength alloy, in a continuous casting process. The contacting solidifies the alloy and creates a profiled strip. The resultant solid profiled strip defines a longitudinal lengthwise axis and a lateral widthwise axis transverse to the longitudinal lengthwise axis. The contacting with the patterned surface of the casting roll or casting block creates a variable thickness profile across the lateral widthwise axis in the solid hot strip. In certain aspects, the contacting creates an asymmetrical thickness profile across the lateral widthwise axis in the solid strip. A ratio of a first region having a maximum thickness ($t_{max}$) to a ratio of a second region having a minimum thickness ($t_{min}$) across the lateral widthwise axis is greater than or equal to about 2.3. The method further comprises cooling the profiled strip having the asymmetrical thickness profile to form the high-strength metal alloy precursor having a tailored thickness that is capable of being tailor rolled into a tailor rolled blank.

In other aspects, the present disclosure provides a method of forming a tailored rolled blank of a high-strength metal alloy. The method optionally comprises contacting a patterned surface of a casting roller or a casting block with a liquid metal, such as a liquid high-strength alloy, in a continuous casting process. The contacting solidifies the alloy and creates a profiled strip. The resultant solid profiled strip defines a longitudinal lengthwise axis and a lateral widthwise axis transverse to the longitudinal lengthwise axis. The contacting with the patterned surface of the casting roll or casting block creates a variable thickness profile across the lateral widthwise axis in the solid hot profiled strip. In certain aspects, the contacting creates a first asymmetrical thickness profile across the lateral widthwise axis in the solid hot strip. A ratio of a first region having a maximum thickness ($t_{max}$) to a ratio of a second region having a minimum thickness ($t_{min}$) across the lateral widthwise axis is greater than or equal to about 2.3. The method optionally further comprises cooling the profiled strip having the first asymmetrical thickness profile. The method may further comprise tailor rolling the profiled strip between at least two tailor rollers to define a second variable thickness profile that is at least about 50% thinner than the first variable thickness profile to create a tailored rolled strip with variable thickness widthwise. In certain aspects, tailor rolling the profiled strip between at least two tailor rollers defines a second asymmetrical thickness profile that is at least about 50% thinner than the first asymmetrical thickness profile to create a tailor rolled strip with variable thickness widthwise. The tailor rolled strip may be further cut into tailor rolled blanks that comprise at least a portion of the second asymmetrical thickness profile.

In yet other aspects, the present disclosure provides a method of forming a high-strength metal alloy structural automotive component having a tailored thickness. The method may optionally comprise tailor rolling a strip of high-strength metal alloy between at least two tailor rollers to define a rolled asymmetrical thickness profile. Prior to tailor rolling, the strip defines a longitudinal lengthwise axis and a lateral widthwise axis transverse to the longitudinal lengthwise axis having an initial variable thickness profile. In certain aspects, the variable thickness profile is an asymmetrical thickness profile. A ratio of a first region having a maximum thickness ($t_{max}$) to a ratio of a second region having a minimum thickness ($t_{min}$) across the lateral widthwise axis in the initial asymmetrical thickness profile is greater than or equal to about 2.3. After tailor rolling, the rolled variable thickness profile is at least about 50% thinner than the initial variable thickness profile. In certain aspects, the rolled variable thickness profile is an asymmetrical thickness profile that is at least about 50% thinner than the initial asymmetrical thickness profile. The method may also include heat treating the strip after it comes out of the rolling. The method also includes cutting the strip to form a blank comprising the rolled asymmetrical thickness profile and subjecting the blank to a forming process to create a unitary high-strength three-dimensionally shaped body component. The body component has a first region having a first thickness exhibiting a load-carrying capacity that is distinct from a second region having a second thickness and the body component is used to form the structural automotive component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
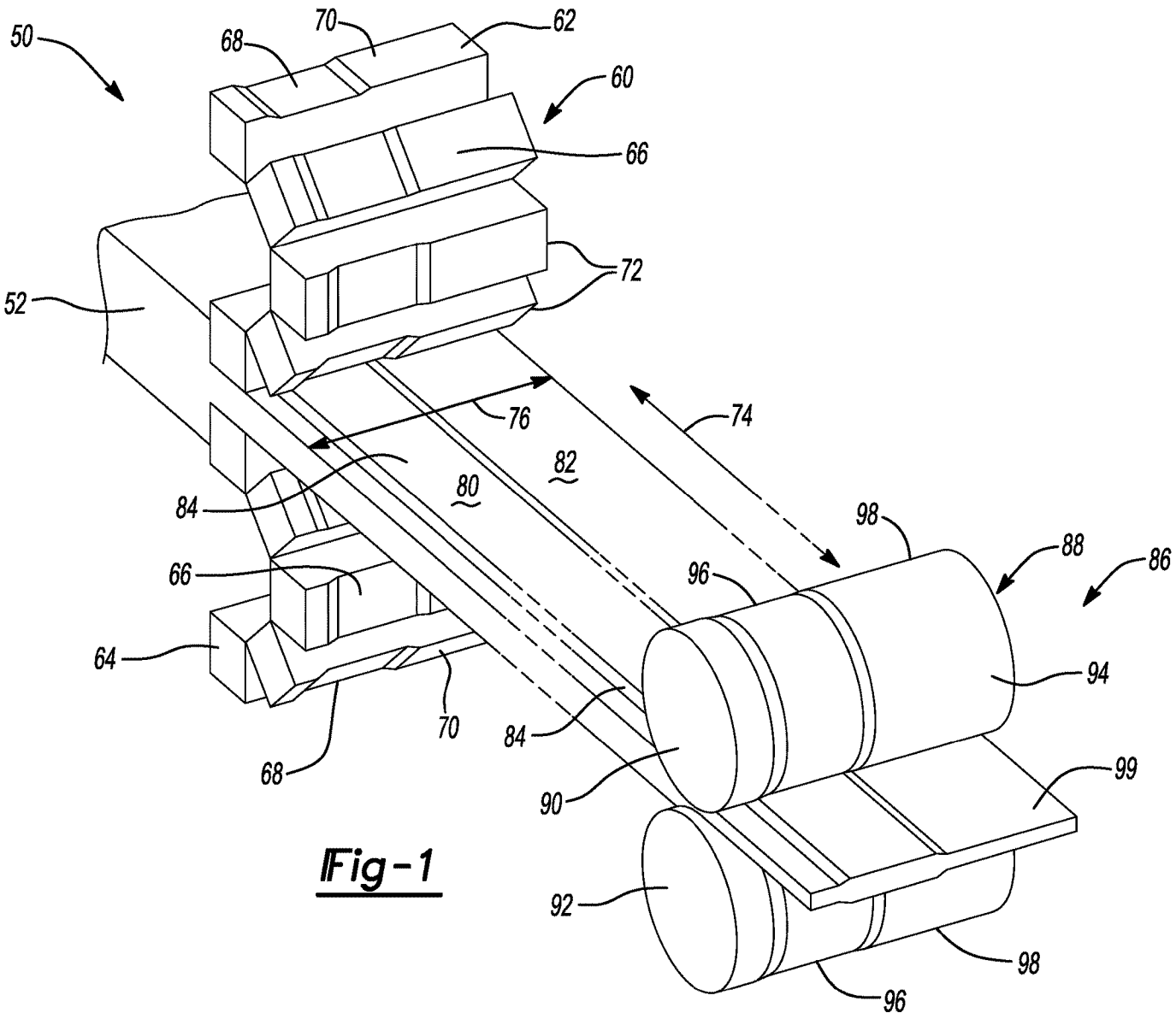
FIG. 1 shows an exemplary schematic of continuous tailored block casting system for forming a high-strength metal alloy precursor having a tailored thickness and a downstream tailor rolling system in accordance with certain aspects of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

It should be understood for any recitation of a method, composition, device, or system that "comprises" certain steps, ingredients, or features, that in certain alternative variations, it is also contemplated that such a method, composition, device, or system may also "consist essentially of" the enumerated steps, ingredients, or features, so that any other steps, ingredients, or features that would materially alter the basic and novel characteristics of the invention are excluded therefrom.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. If, for some reason, the imprecision provided by "about" is not otherwise understood in the art with this ordinary meaning, then "about" as used herein may indicate a possible variation of up to 5% of the indicated value or 5% variance from usual methods of measurement.

As used herein, the term "composition" refers broadly to a substance containing at least the preferred metal elements or compounds, but which optionally comprises additional substances or compounds, including additives and impurities. The term "material" also broadly refers to matter containing the preferred compounds or composition.

In addition, disclosure of ranges includes disclosure of all values and further divided ranges within the entire range, including endpoints and sub-ranges given for the ranges.

In various aspects, the present disclosure provides methods of forming a high-strength metal alloy precursor having a tailored thickness that can be subsequently tailor rolled. The present disclosure also contemplates methods of forming a tailored rolled blank of a high-strength metal alloy. In yet other aspects, the present disclosure provides a method of forming a high-strength metal alloy structural automotive component having a tailored thickness that includes tailor rolling a high-strength metal alloy, followed by forming the tailor rolled alloy into a complex three-dimensional high-strength shaped body having asymmetrical thickness (e.g., by a roll forming process).

Thus, in certain aspects, the present disclosure contemplates forming a high-strength metal alloy precursor having a tailored thickness. The present disclosure provides methods for tailor-casting strips with varying thickness throughout the width, which can be further rolled to a final required thickness profile or tailored thickness more efficiently than starting from a constant thickness stock, as is done conventionally. In certain aspects, such a method can be conducted by contacting a patterned surface of a casting roller or a casting block with a liquid metal, such as a liquid high-strength alloy, in a continuous casting process to produce a solidified hot strip. A liquid as used herein may include a flowable metal that may be in a liquid state or semi-solid state. As used herein, the term strip will refer to a material, including a sheet, stock, or other material that has a greater length than width. A solidified hot strip may have a temperature less than the high-strength alloy's melting point, but at least 100° C. above room temperature (e.g., 21° C.), and thus may be in a solid or semi-solid state that can retain a pattern and surface profile after contact with the variable thickness profile patterned surface of the casting roller or casting block. The variable thickness profile is thus created before or during solidification as contact with the casting block or casting roller occurs. In this manner, the present disclosure provides methods of continuously casting a strip having varying thickness across the width, which allows for improved product in subsequent processing, like tailor rolling.

The strip defines a longitudinal lengthwise axis and a lateral widthwise axis transverse to the longitudinal lengthwise axis. The contacting therefore creates a variable thickness profile so that the thickness differs across the lateral widthwise axis of the strip. In certain variations, a ratio of a first region having a maximum thickness ($t_{max}$) to a second region having a minimum thickness ($t_{min}$) across the lateral widthwise axis is greater than or equal to about 2.3, optionally greater than or equal to about 2.5, and in certain variations, optionally, greater than or equal to about 3.0, as will be described in greater detail below. In accordance with certain desirable aspects of the present disclosure, the thickness varies across the lateral widthwise axis so that it can be considered to be an asymmetrical thickness profile, where the thickness profile (corresponding to different regions with different thicknesses) does not repeat symmetrically or in a regular repeated pattern across the width of the strip or sheet.

After contacting the liquid metal with the patterned surface of the casting roller or the casting block, the solidified strip of high-strength metal alloy can be cooled (for example, to ambient conditions) to form the high-strength metal alloy precursor having a desired variable thickness profile across the lateral widthwise axis, for example, an asymmetrical thickness profile. The precursor thus has a tailored thickness that is capable of being tailor rolled into a tailor rolled blank, as will be described further below. Such a tailor-cast strip allows for more uniform reduction (and thus better microstructure control) during the subsequent tailor rolling processes to provide a superior tailor rolled blank. This can improve the ability to make tailor-rolled blanks with properties that are controllable via varying thickness of the starting strip material.

Generally, the cast profiled strip may be produced with a casting roller or a casting block having a profiled or patterned surface, so that the resulting thickness after solidification is ideal for the subsequent tailor rolling process. FIG. 1 shows a representative continuous tailored block casting system 50 for forming a high-strength metal alloy precursor having a tailored thickness. The liquid metal 52 exits a furnace and any upstream metal handling equipment (not shown). The liquid 52 may have a temperature that is near or greater than the high-strength alloy's melting point, for example, greater than or equal to about 1300° C. in the case of typical high-strength steel alloys, depending on the material composition and casting conditions. The liquid 52 may be continuously conveyed via any metal handling equipment typically used in metal forming industry.

The liquid 52 passes by a pair of casting blocks 60 (shown in a partial view) that include an upper casting block 62 and a lower casting block 64 and exits as a hot solidified precursor strip 84 material. Each of the upper casting block 62 and lower casting block 64 have a patterned surface 66 including at least two regions having different thickness profiles. The patterned surface 66 includes a first region 68 having a first depth and a second region 70 having a second depth, which is distinct from the first depth. While only shown as a first region 68 and second region 70, the patterned surface 66 may have many distinct regions with different profiles/depths. Furthermore, while the upper casting block 62 and lower casting block 64 are shown to have the same patterned surface 66, in alternative variations, the patterns and depths of the patterned surfaces 66 may vary between the upper casting block 62 and lower casting block 64.

Each of the casting blocks 62, 64 includes articulated segments 72 that can be continuously moved to bring the patterned surface 66 into contact with the liquid 52 to force the liquid along the patterned surface 66 as it passes, thus creating a thickness profile in the material as it solidifies and forms the precursor strip 84. The pair of casting blocks 60 may be cooled, for example with internal cooling systems, to maintain and regulate temperature along the patterned surface 66 as it contacts liquid 52 and facilitates solidification. The solidified precursor strip 84 defines a longitudinal lengthwise axis 74 and a lateral widthwise axis 76 transverse to the longitudinal lengthwise axis 74. As such, contact with the patterned surface 66 of the upper casting block 62 and lower casting block 64 creates a thickness profile where thickness varies across the lateral widthwise axis 76 of the solidified precursor strip 84. After passing through and contacting the pair of casting blocks 60, a first region 80 of the solidified precursor strip 84 may have a first thickness that corresponds to the first region 68 having the first depth on the patterned surface 66. A second region 82 of the solidified precursor strip 84 may have a second thickness that corresponds to the second region 70 having the second depth on the patterned surface 66. Thus, after patterning, the liquid 52 is transformed into a solidified precursor strip 84 that can be further tailor rolled and processed. As only two distinct thickness sections are shown in the solidified precursor strip 84 in FIG. 1 for simplicity, the first region 80 of the strip 52 is thicker than the second region 82, because the first region 68 of the patterned surface 66 has a greater depth than the second region 70 of the patterned surface 66.

In various aspects, the present disclosure facilitates significant and large transitions in thickness across the lateral widthwise axis 76, which was not previously possible. Thus, in certain variations, a ratio of the first region 80 having a maximum thickness ($t_{max}$) to a ratio of the second region 82 having a minimum thickness ($t_{min}$) across the lateral widthwise axis 76 is greater than or equal to about 2.3, optionally greater than or equal to about 2.5, and in certain variations, optionally, greater than or equal to about 3.0, as will be described in greater detail below. In accordance with certain aspects of the present disclosure, the thickness varies across lateral widthwise axis 76 so that it can be considered to be an asymmetrical thickness profile, where the thickness profile in that first region 80 and second region 82 do not repeat evenly in a pattern across the lateral widthwise axis 76. Notably, other regions with differing thicknesses may be formed in the solidified precursor strip 84 and even regions having the same thicknesses repeated, although preferably such regions are not repeated in a regular pattern. The ability to create an asymmetrical thickness profile is particularly desirable in forming complex three-dimensional shaped products. In this manner, the thicknesses and attendant material properties can be highly tailored in the solidified precursor strip 84 to better match and correspond to the required thicknesses widthwise in the three-dimensional part to be tailor rolled and formed, which was not previously possible. Furthermore, the microstructure is improved when using such a precursor. Thus, after contacting with the hot solidified precursor strip 84 of metal alloy with the pair of casting blocks 60, the solidified precursor strip 84 can be cooled, for example to room temperature.

As shown in FIG. 1, the solidified precursor strip 84 can then be processed in a subsequent tailor rolling station 86. Such a tailor rolling station 86 may be in the same facility as the casting/tailored block casting system 50 or may be in a different processing facility. If the solidified precursor strip 84 is transported to a different processing facility, it may be coiled and uncoiled and then processed in the tailor rolling station 86. If the subsequent tailor rolling is performed as hot rolling, the process may involve furnaces to heat to the desired rolling temperature before or between rolling steps. The tailor rolling station 86 includes a pair of tailor rollers 88, including an upper tailor roller 90 and a lower tailor roller 92. The present disclosure contemplates use of multiple pairs of tailor rollers 88 (a train of tailor rollers), which may be used for hot rolling or cold rolling. Each of the upper tailor roller 90 and lower tailor roller 92 has a patterned surface 94 including at least two regions having different thickness profiles. Like the patterned surface 66 of the pair of casting blocks 60, the patterned surface 94 includes a first region 96 having a first depth and a second region 98 having a second depth, which is distinct from the first depth. While only shown as a first region 96 and second region 98, the patterned surface 94 may have many distinct regions with different profiles/depths. Notably, the patterned surface 94 of the pair of tailor rollers 88 may have the same or a similar thickness profile to the patterned surface 66 of the pair of the casting blocks 60, although the tailor roller first region 96 and second region 98 will have different depths than first region 68 and second region 70 to create a thinner precursor product 99 having the desired thickness profile as it passes by the pair of tailor rollers 88. In certain aspects, the reduced thickness precursor product 99 is subsequently heat treated to modify the material properties as needed.

For example, tailor rolling the solidified precursor strip 84 between at least two tailor rollers 88 may create a thickness profile that is at least about 50% thinner than the thickness profile to create a tailored rolled blank with variable thickness widthwise. This concept is further illustrated in FIGS. 2 and 3. After treating the liquid metal by passing it into contact with a profiled/patterned surface, such as patterned surface 66 of the pair of casting blocks 60, a precursor strip 100 is formed. As shown in representative precursor strip 100 (similar to solidified precursor strip 84 in FIG. 1) has a first region 102 of the precursor strip 100 that is thicker than a second region 104 (corresponding to the first region 68 of the patterned surface 66 of casting blocks 60 having a greater depth than the second region 70 of the patterned surface 66). Thus, the first region 102 has a first thickness (or height) that is thicker than the second region 104 having the second thickness (or height). Notably, a third region 106 has a third thickness (or height) that is the same as the second thickness in the second region 104. The first thickness of the first region 102 corresponds to the maximum thickness ($t_{max}$) of the precursor strip 100, while the second thickness in the second region 104 corresponds to the minimum thickness ($t_{min}$) of the precursor strip 100.

Figure 2:
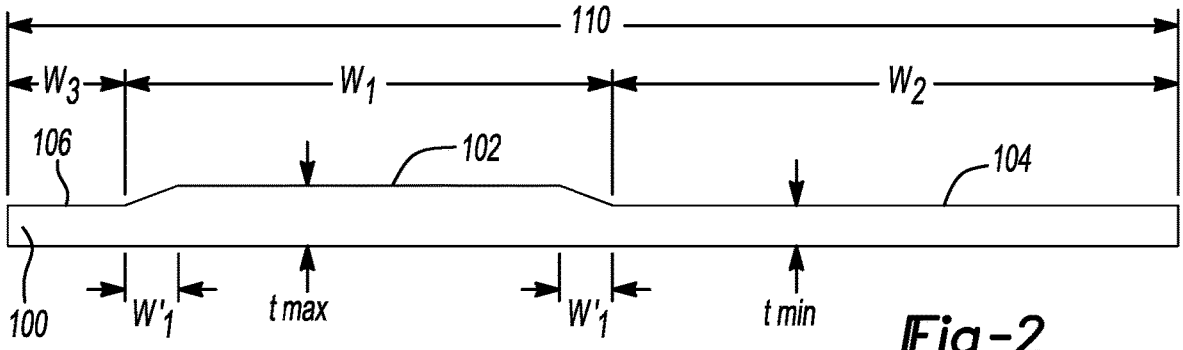
FIG. 2 shows a cross-sectional view of a high-strength metal alloy precursor having a tailored asymmetrical thickness profile varying across a lateral widthwise axis prepared in accordance with certain aspects of the present disclosure.

In certain aspects, contacting the hot solidified strip with the patterned surface creates a thickness profile so that the thickness varies across a lateral widthwise axis 110 of the strip. In certain variations, a ratio of the first region 102 having a maximum thickness ($t_{max}$) to a ratio of the second region 104 having a minimum thickness ($t_{min}$) across the lateral widthwise axis 110 is greater than or equal to about 2.3, optionally greater than or equal to about 2.5, and in certain variations, optionally, greater than or equal to about 3.0, as will be described in greater detail below. In one variation, the first region 102 may have a thickness ranging from greater than or equal to about 8 mm to less than or equal to about 25 mm, for example, about 9.2 mm, while the second and third regions 104, 106 may have thicknesses ranging from greater than or equal to about 3 mm to less than or equal to about 10 mm, for example, about 6 mm, while complying with the maximum/minimum thickness ratios specified above. As shown in FIG. 2, the variation in thicknesses across the lateral widthwise axis 110 can be considered to form an asymmetrical thickness profile. As noted above, prior to the present technology, it was not possible to create asymmetrical thickness profiles widthwise in strips of high-strength alloy materials. While not shown, the asymmetrical thickness profile across the lateral widthwise axis 110 may also have one or more additional thickness regions distinct from the first and second regions. For example, a third region having a third thickness greater than the minimum thickness ($t_{min}$) and less than the maximum thickness ($t_{max}$) may be present.

The first region 102 of the precursor strip 100 has a first width designated "$w_1$." The first width $w_1$ includes transition regions $w'_1$ where the precursor strip 100 thickness increases from the second thickness (shown as $t_{min}$) in the second region 104 to the first thickness (shown as $t_{max}$) of the first region 102 or third thickness of the third region 106. The second region 104 has a second width designated "$w_2$" and the third region 106 has a third width designated "$w_3$."

In certain variations, the precursor strip 100 may have an overall total width (measured across lateral widthwise axis 110) of greater than or equal to about 120 mm up to about 2,000 mm (e.g., greater than or equal to about 2 m), while in certain variations an overall total width may optionally be greater than or equal to about 500 mm to less than or equal to about 2,000 mm. In certain aspects, a maximum width of the first region 102 may be greater than or equal to about 60 mm to less than or equal to about 1,800 mm. A maximum width of the second region 104 may likewise be greater than or equal to about 60 mm to less than or equal to about 1,800 mm. In certain aspects, a maximum width of the first region 102 may be greater than or equal to about 60 mm to less than or equal to about 100 mm and a maximum width of the second region 104 may be greater than or equal to about 60 mm to less than or equal to about 125 mm.

Figure 3:
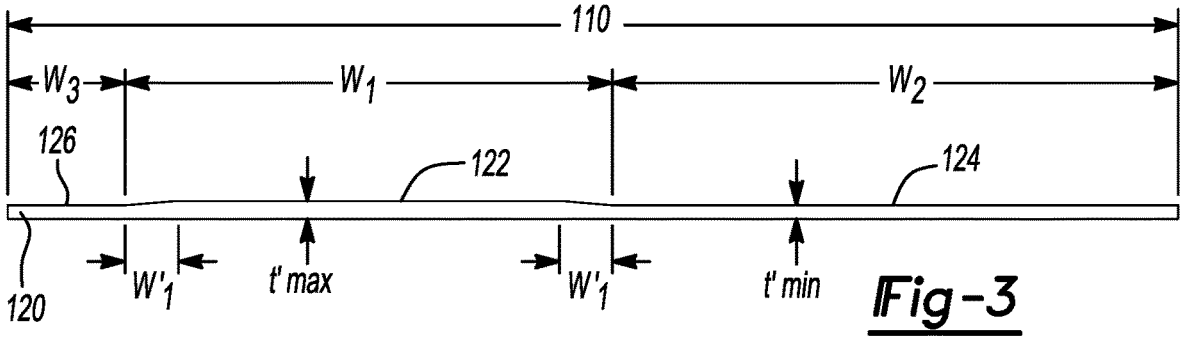
FIG. 3 shows a cross-sectional view of a high-strength metal alloy tailor rolled product having a tailored asymmetrical thickness profile varying across a lateral widthwise axis prepared in accordance with certain aspects of the present disclosure.

FIG. 3 shows a tailor rolled product 120 after tailor rolling (for example, by tailor rollers 88 in tailor rolling station 86 in FIG. 1 that form precursor product 99), where the thickness is further reduced as compared to an initial thickness in precursor strip 100. In the present disclosure, the pair of tailor rollers 88 can be rotated, but can have a fixed position with respect to height over the passing precursor strip 100. In this manner, the present methods and systems provide significantly improved quality in providing uniform thickness reduction across the width of the precursor strip 100 (to create a superior thickness profile) and avoiding oscillating rolls that introduce undesirable variability into the thicknesses formed in the material being tailor rolled.

A first region 122 of the tailor rolled product 120 is thicker than a second region 124 (corresponding to the first region 102 and the second region 104 of the precursor strip 100). Thus, the first region 102 has a first thickness (or height) that is thicker than the second region 104 having the second thickness (or height). Notably, a third region 126 has a third thickness (or height) that is the same as the second thickness in the second region 124 (and corresponds to the third region 106 of the precursor strip 100). The first thickness of the first region 122 corresponds to a maximum thickness ($t'_{max}$) of the tailor rolled product 120, while the second thickness in the second region 124 corresponds to a minimum thickness ($t'_{min}$) of the tailor rolled product 120.

The first region 122 of the tailor rolled product 120 also has the first width designated w1, which is substantially the same as the first width w1 of first region 102 in the precursor strip 100. The first width w1 of first region 122 includes the same transition regions w'1 as the tailor rolled product's 120 thickness increases from a second thickness (shown as t'min) in the second region 124 to the first thickness (shown as t'max) of the first region 122 or third thickness of the third region 126. The second region 124 has a second width designated $w_2$" and the third region 126 has a third width designated "$w_3$."

The $t_{max}$ of the precursor strip 100 in FIG. 2 is thus reduced by greater than or equal to about 50% to form $t'_{max}$ of tailor rolled product 120 in FIG. 3 after the tailor rolling process. In certain variations, $t_{max}$ is reduced by greater than or equal to about 75% to form $t'_{max}$. For example, where $t_{max}$ is about 9.2 mm, it can be reduced by about 75% to form $t'_{max}$ of about 2.3 mm after tailor rolling ((9.2 mm−2.3 mm)/9.2 mm=0.75*100=75%). Likewise, the $t_{min}$ of the precursor strip 100 in FIG. 2 may be reduced by greater than or equal to about 50% to form $t'_{min}$ of tailor rolled product 120 in FIG. 3 after the tailor rolling process. In certain variations, $t_{min}$ is reduced by greater than or equal to about 75% to form $t'_{min}$. For example, where $t_{min}$ is about 4.0 mm, it can be reduced by about 75% to form $t'_{min}$ of about 1.0 mm after tailor rolling ((4.0 mm−1.0 mm)/4.0 mm=0.75*100=75%). The amount of reduction of thickness in the tailor rolling process to form the tailor rolled product 120 may be the same for both the minimum and maximum thicknesses (in other words, the amount of reduction of thickness is even across the entire lateral widthwise axis 110). The amount of thickness reduction may be even greater than 75%, for example, greater than or equal to about 80%, optionally greater than or equal to about 85%, and greater than or equal to about 90% in certain variations.

Thus, a ratio of a first region 122 having a maximum thickness ($t'_{max}$) to a ratio of a second region 124 having a minimum thickness ($t'_{min}$) across a lateral widthwise axis 110 in the tailor rolled product 120 remains the same as that of the precursor strip prior to tailor rolling. The ratio of $t'_{max}$ to $t'_{min}$ may thus be greater than or equal to about 2.3, optionally greater than or equal to about 2.5, and in certain variations, optionally, greater than or equal to about 3.0. In one variation, the first region 122 may have a thickness ranging from greater than or equal to about 1.5 mm to less than or equal to about 3.5 mm, for example, about 2.3 mm, while the second and third regions 124, 126 may have thicknesses ranging from greater than or equal to about 0.5 mm to less than or equal to about 1.5 mm, for example, about 1 mm, while complying with the maximum/minimum thickness ratios specified above. FIG. 3 retains an asymmetrical thickness profile across the lateral widthwise axis 110.

In certain aspects, a maximum width of the first region 122 in the tailor rolled product 120 may be greater than or equal to about 60 mm to less than or equal to about 1,800 mm. A maximum width of the second region 124 may likewise be greater than or equal to about 60 mm to less than or equal to about 1,800 mm. In certain aspects, a maximum width of the first region 122 may be greater than or equal to about 60 mm to less than or equal to about 100 mm and a maximum width of the second region 124 may be greater than or equal to about 60 mm to less than or equal to about 125 mm.

In various aspects, the present disclosure provides methods for forming a tailored precursor from a sheet or strip of a high-strength metal alloy blank. The high-strength metal alloy may be selected from the group consisting of: high-strength steel alloys, aluminum alloys, magnesium alloys, titanium alloys, and combinations thereof. Representative high-strength metal alloys may include advanced high strength steels, such as third generation advanced high strength steels, like quenched and partitioned (Q&P) and medium-manganese steels, transformation induced plasticity (TRIP) steel, like TRIP 690 and TRIP 780, dual phase (DP) steel, complex phase (CP) steel, high-strength low alloy (HLSA) steel, martensitic (MS) steel, stainless steels, 5000 series aluminum alloys, 6000 series aluminum alloys, 7000 series aluminum alloys, and the like.

A sheet or strip of the high-strength metal may be a coil of metal material not yet cut into individual blanks. After tailoring rolling, the tailor rolled product 120 may be further treated and processed. For example, the tailor rolled product 120 may be subjected to secondary heat treatment (for example, after coiling the tailor rolled product 120 into a coil). Alternatively, the tailor rolled product 120 may be transferred to a blanking station (not shown) where the sheet of tailor rolled product 120 is cut into smaller, discrete distinct blanks or sheets that may be formed into separate three-dimensional body components having three-dimensional geometrical cross-sections.

Figure 4:
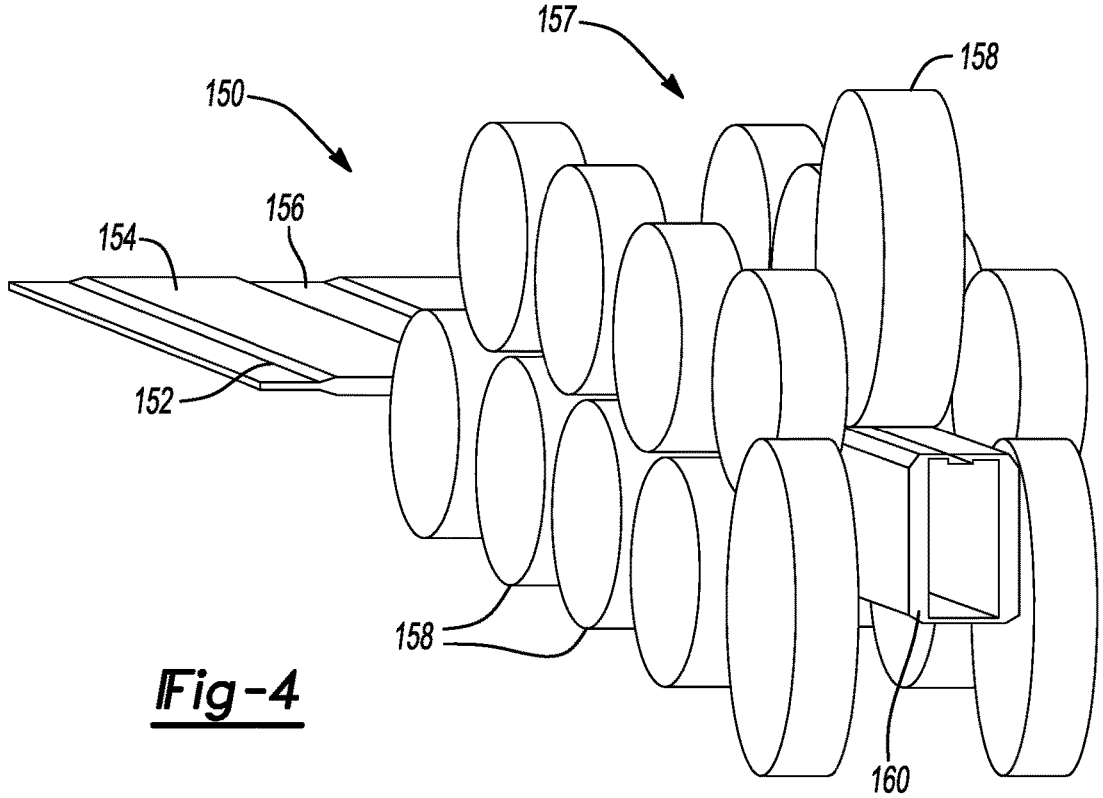
FIG. 4 shows an exemplary continuous roll forming system for processing a tailor rolled blank having a tailored thickness profile that forms a complex three-dimensional body portion of a structural component in accordance with certain aspects of the present disclosure.

FIG. 4 shows an exemplary continuous roll forming system 150. A tailor blank rolled product has been processed in accordance with certain aspects of the present disclosure and therefore may have a thickness profile formed first by casting thickness profiling widthwise, followed by tailor blank rolling. Thus, the tailor blank rolled strip product may be cut into a tailor rolled blank 152 that has at least one first region 154 with a first thickness and a second region 156 with a second distinct thickness widthwise. The tailor rolled blank 152 is conveyed into a multi-roller train 157 having a plurality of rollers 158 at different heights and positions that process and shape the passing metal material via rolling into a complex three-dimensionally shaped part. The material may be cold rolled or hot rolled at an elevated temperature (below the melting point of the alloy). In the continuous roll forming system 150, the tailor rolled blank 152 having a variable widthwise thickness profile may be roll formed to create a unitary high-strength three-dimensionally shaped body component 160. It should be noted that other alternative techniques for forming three-dimensionally shaped structures from tailor rolled blanks with variable thickness, such as stamping, bending, brake forming, hydroforming, press hardening, and the like. The high-strength three-dimensionally shaped body component may have a load-carrying capacity and therefore exhibit a strength of greater than or equal to about 400 MPa, optionally from greater than or equal to about 400 MPa to less than or equal to about 2,000 MPa.

Figure 5:
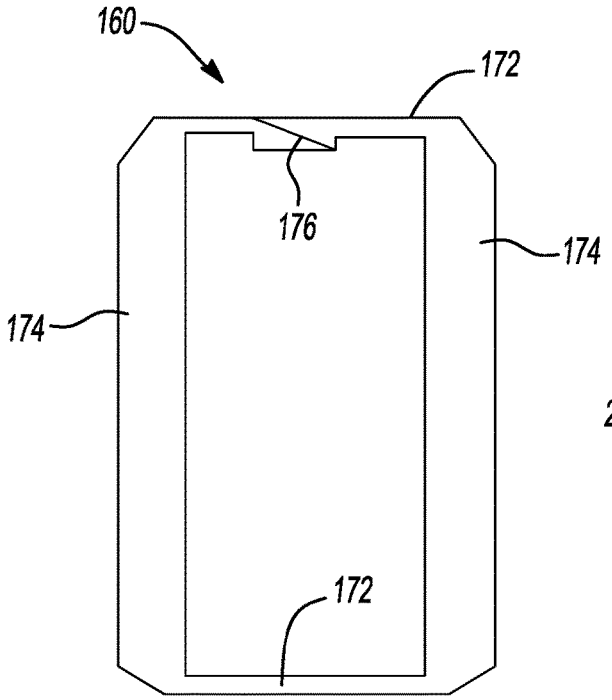
FIG. 5 shows a cross-sectional view of a complex three-dimensional body portion of a structural component after being formed in the roll forming system in FIG. 4 in accordance with certain aspects of the present disclosure.

A cross-section of a representative body component 160 formed in the continuous processing system 150 in FIG. 4 is shown in FIG. 5. The body component 160 formed via roll forming may be free of any welds. The body component 160 has a plurality of first regions 172 having a first thickness and a plurality of second regions 174 having a second thickness, where the first thickness is less than the second thickness. As shown, the blank is folded upon itself at a seam 176 to form an enclosed structure. It should be noted that the multiple regions having distinct thicknesses can be formed via the principles of the present disclosure. Thus, the body component 160 has different regions exhibiting distinct material properties, depending on the thicknesses of each region. In certain aspects, the second region 174 of the body component is high-strength in that it exhibits a strength of greater than or equal to about 400 MPa to less than or equal to about 2,000 MPa. The ability to selectively control thicknesses widthwise on a tailor rolled blank enables a wide range of new design options for structural components that were not previously possible with cold tailor blank rolling forming lengthwise with variable thickness widthwise.

The tailor rolled metal blank can be further processed to form a high-strength component, such as an automotive component. The main portion of the high-strength component can be a unitary three-dimensional body. As referred to herein, a "unitary" structure is one having at least a portion that is constructed from a single blank. In certain aspects, the present disclosure thus contemplates high-strength structural automotive components that may comprise a unitary three-dimensional body portion formed of a high-strength metal alloy. The unitary three-dimensional body component has a first region exhibiting at least one material property, such as strength, distinct from a second region. Material properties may include by way of non-limiting example, tensile strength, yield strength, stiffness, ductility, elongation, formability, energy absorption, and the like, as well as combinations thereof. The distinct properties in the body component are due to variable thickness imparted from widthwise variable thickness of the tailor rolled blank in accordance with certain aspects of the present disclosure.

While the unitary high-strength structures are particularly suitable for use in components of an automobile or other vehicles (e.g., motorcycles, boats, tractors, buses, motorcycles, mobile homes, campers, and tanks), they may also be used in a variety of other industries and applications, including aerospace components, consumer goods, office equipment and furniture, industrial equipment and machinery, farm equipment, or heavy machinery, by way of non-limiting example. Non-limiting examples of vehicles that can be manufactured by the current technology include automobiles, tractors, buses, motorcycles, boats, mobile homes, campers, and tanks. Other exemplary structures that have frames that can be manufactured by the current technology include buildings, such as houses, offices, sheds, warehouses, and devices. The high-strength structural automotive component may be selected from the group consisting of: rocker rails, structural pillars, A-pillars, B-pillars, C-pillars, D-pillars, hinge pillars, vehicle doors, roofs, hoods, trunk lids, engine rails, and combinations thereof in certain variations.

Figure 6:
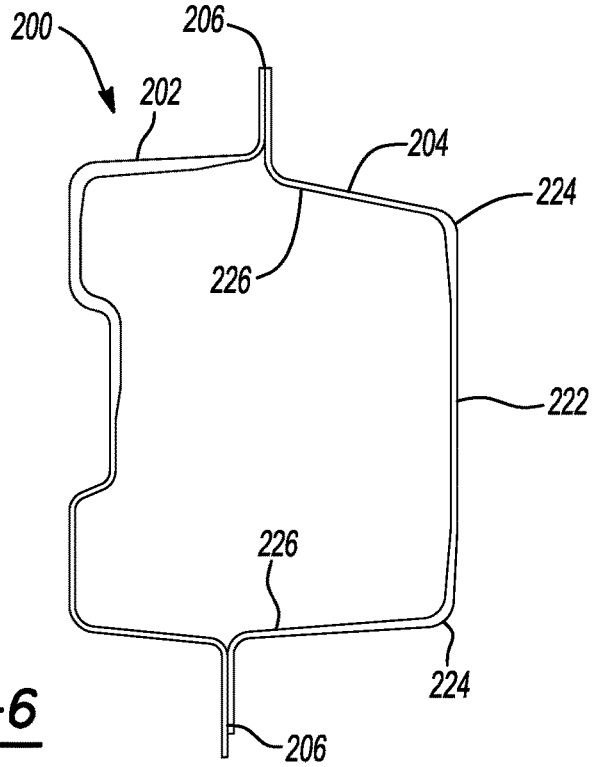
FIG. 6 shows a sectional view of a high-strength automotive rocker rail assembly formed from a high-strength metal alloy tailor rolled product having a tailored thickness profile varying across a lateral widthwise axis prepared in accordance with certain aspects of the present disclosure.
Figure 7:
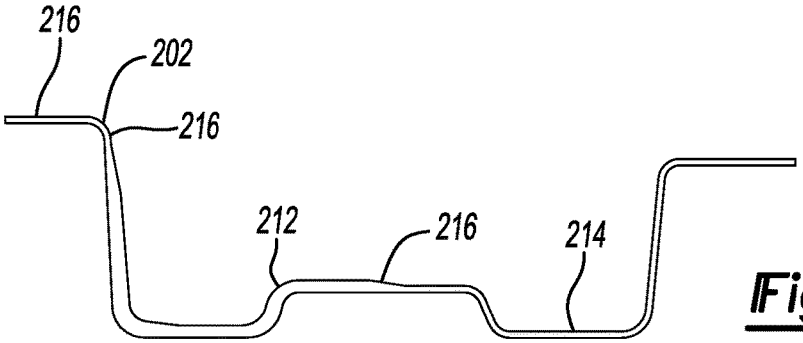
FIG. 7 shows a sectional view of an inner panel of the high-strength automotive rocker rail assembly in FIG. 6.

FIGS. 6 and 7 show a high-strength structural automotive component assembly incorporating a unitary three-dimensional body portion formed of a high-strength metal alloy in accordance with certain aspects of the present disclosure. More specifically, the high-strength structural automotive component assembly in FIG. 6 is a sectional view of a representative rocker rail structure or assembly 200. The rocker rail assembly 200 includes an inner panel 202 and an outer panel 204 that are joined together at seams or joints 206. FIG. 7 shows a sectional view of the inner panel 202. Inner panel 202 is formed from a tailor rolled blank formed in accordance with the present disclosure like tailor rolled product 120 in FIG. 3, itself formed by tailor rolling formed from precursor strip 100 in FIG. 2. Thus, the inner panel 202 has been formed from a tailor rolled blank that was roll processed in a process similar to that shown in FIG. 4 to create a three-dimensional structure having a complex formed shape. Alternatively, the entire cross-section (perimeter) can be roll formed in accordance with the process shown in FIG. 4.

The inner panel 202 includes a first region 212 with a first thickness (corresponding to the first region 122 of the tailor rolled product 120), a second region 214 with a second thickness (corresponding to the second region 124 of the tailor rolled product 120), and a third region 216 having a third thickness (corresponding to the third region 126 of the tailor rolled product 120). It should be noted that during the roll forming or other three-dimensional shaping process, the thicknesses of the tailor rolled blank may be further altered in certain areas and thus may create additional regions of thickness. As shown, the first thickness of the first region 212 is greater than the second thickness of the second region 214 and the third thickness of the third region 216. Furthermore, two transition regions 216 are formed where the thicknesses increase/decrease between distinct regions having different thicknesses. In this manner, a tailor rolled blank prepared in accordance with certain aspects of the present technology having variable thickness widthwise, and more specifically, asymmetric variable thickness in an asymmetric thickness profile, is used to form a unitary three-dimensional high-strength body portion.

Outer panel 204 likewise has variable thickness widthwise that includes a first region 222 with a first thickness, two second regions 224 having a second thickness, and two third regions 226 having a third thickness. As shown, the second thickness of second region 224 is greater than the first thickness of the first region 222 or third thickness of the third region 226. The thickest and strongest second regions 224 correspond to the corners of the outer panel. The first region 222 has a reduced thickness to provide mass reduction. The outer panel 204 may then be joined to inner panel 202, as shown in the assembly in FIG. 6 to form a structural rocker rail assembly for an automobile. The rocker rail assembly 200 formed with components made in accordance with certain aspects of the present disclosure enables the elimination of various reinforcement pieces, such as corner reinforcements, that have been conventionally used to provide additional strength to the assembly in regions that are required to withstand high forces.

Figure 8:
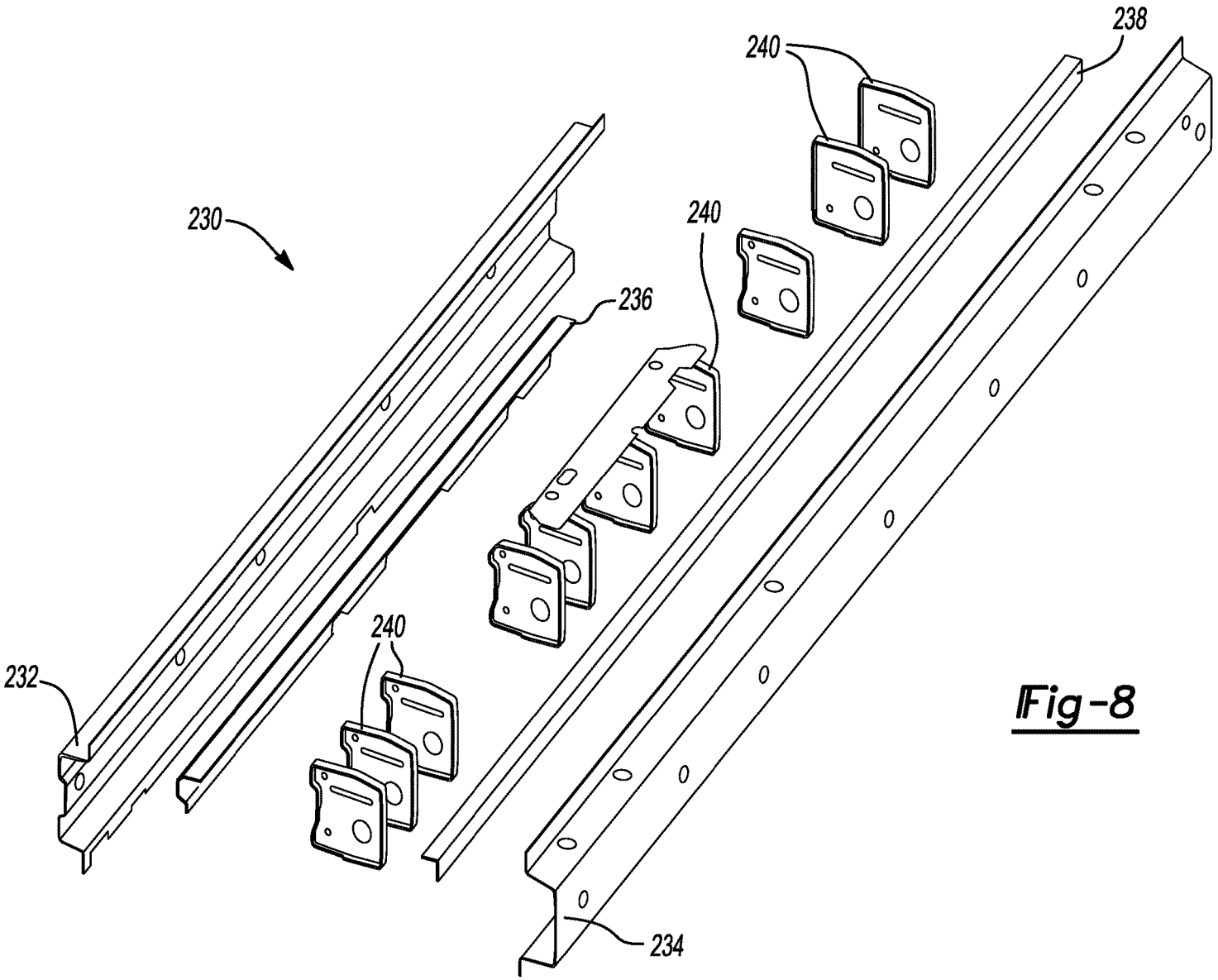
FIG. 8 shows an exploded view of a conventional rocker rail assembly having corner reinforcements and internal stiffening baffles.

FIG. 8 shows an exploded view of a conventional rocker rail assembly 230. The rocker rail assembly 230 includes an inner panel 232 and an outer panel 234. The rocker rail assembly 230 includes a first corner reinforcement 236 and a second corner reinforcement 238. A series of internal stiffening baffles 240 are disposed within the center of the rocker rail assembly 230. When assembled, the inner panel 232 is joined to the outer panel 234 with the first and second corner reinforcements 236, 238 fortifying the corners and the internal stiffening baffles 240 providing additional stiffness and strength internally. In comparing the design of the rocker rail assembly 200 formed with tailor rolled blanks formed in accordance with the present disclosure (in FIGS. 6 and 7) with the conventional rocker rail assembly 230 design in FIG. 8, first and second corner reinforcements 236, 238 can be eliminated by integrating metal into a thicker corner during casting. This design of the rocker rail assembly 200 thus eliminates separate corner reinforcement and associated spot welding, which can lead to further distortion. In certain variations, some or all of the internal stiffening baffles 240 may be eliminated from the rocker rail assembly. In this manner, a tailor rolled blank prepared in accordance with certain aspects of the present technology having variable thickness widthwise, and more specifically, asymmetric variable thickness in an asymmetric thickness profile, is used to form a three-dimensional high-strength structural component for an automobile that has higher strength, better mechanical performance, and is also lighter weight.

Thus, in various aspects, the present disclosure provides methods of continuously casting a strip of material produced with varying thickness across the width of the strip, which allows for efficient tailor rolling in subsequent processing. The cast strip having a widthwise varying thickness profile is first produced with profiled rollers and/or blocks, so that the resulting thickness is ideal for the subsequent tailor rolling process. Tailor-casting the strip in this manner allows for more uniform reduction (and thus better microstructure control) during the subsequent tailor rolling processes. This improves the ability to make tailor-rolled blanks with properties that are controllable using the thickness of the starting strip. Furthermore, the methods of tailoring-casting a strip in accordance with certain aspects of the present disclosure increase a range of available thicknesses for tailor-rolling. The processes of the present disclosure and materials made from such processes are lower in cost due to more efficient rolling process compared with a conventional cold rolling tailor rolling process. The methods of the present disclosure can further avoid the cost and stress concentration that arises from tailor welding various blanks together to form the blank suitable for forming.

Figure 9:
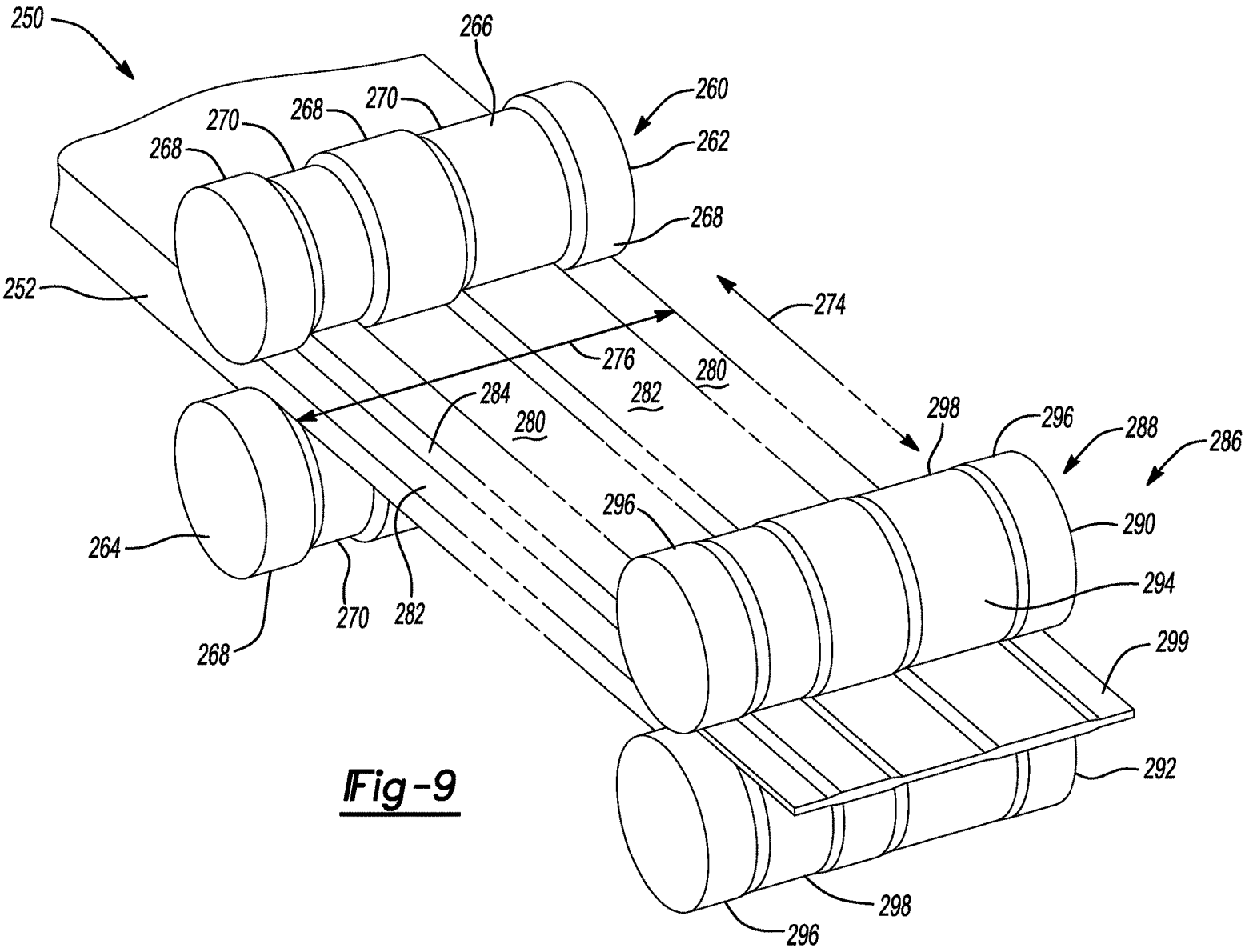
FIG. 9 shows an exemplary schematic of continuous casting roller system for forming a high-strength metal alloy precursor having a tailored thickness and a downstream tailor rolling system in accordance with certain aspects of the present disclosure.

FIG. 9 shows an alternative variation of the present disclosure, where the methods are conducted in continuous casting roller system 250 for forming a high-strength metal alloy precursor having a tailored thickness. The liquid 252 high-strength metal alloy exits a furnace and any metal handling systems (not shown). The liquid 252 may have a temperature that is near or greater than the high-strength alloy's melting point, for example, any of those described above in the context of FIG. 1. The liquid 252 may be continuously conveyed via any metal handling equipment typically used in metal forming industry.

The liquid 252 enters a pair of casting rollers 260 that include an upper casting roller 262 and a lower casting roller 264. Each of the upper casting roller 262 and lower casting roller 264 has a patterned surface 266 including at least two regions having different thickness profiles. As shown, the patterned surface 266 includes a plurality of first regions 268 having a first depth and a plurality of second regions 270 having a second depth, which is distinct from the first depth. While only shown as first regions 268 and second regions 270, the patterned surface 266 may have many distinct regions with different profiles/depths and the first and second regions 268, 270 may be of different thicknesses. Furthermore, while the upper casting roller 262 and lower casting roller 264 are shown to have the same patterned surface 266, in alternative variations, the patterns and depths of the patterned surfaces 266 may vary between the upper casting roller 262 and lower casting roller 264. The pair of casting rollers 260 could also have a different orientation, for example, the pair of casting rollers 260 could be oriented such that the metal flows vertically past them, rather than horizontally as shown in FIG. 9.

The pair of casting rollers 260 may be rotated at a fixed height above the passing strip 252 to force the liquid 252 into contact with the patterned surface 266 to solidify the material as it passes, thus creating a thickness profile in the solidified precursor strip 284. Each of the casting rollers 260 may be cooled, for example with internal cooling systems, to maintain and regulate temperature along the patterned surface 266 as it contacts liquid 252 and facilitates solidification. The solidified precursor strip 284 defines a longitudinal lengthwise axis 274 and a lateral widthwise axis 276 transverse to the longitudinal lengthwise axis 274. As such, contact with the patterned surface 266 of the upper casting roller 262 and lower casting roller 264 creates a thickness profile where thickness varies across the lateral widthwise axis 276 of solidified precursor strip 284. After passing through and contacting the pair of casting rollers 260, a plurality of first regions 280 of the solidified precursor strip 284 may have a first thickness that corresponds to the first region 268 having the first depth on the patterned surface 266. A second region 282 of the strip 252 may have a second thickness that corresponds to the second region 270 having the second depth on the patterned surface 266. Thus, after patterning, the liquid 252 is transformed into a solidified precursor strip 284 that can be further tailor rolled and processed.

As only two distinct thickness sections are shown in the precursor strip 284 in FIG. 1 for simplicity, the first regions 280 of the solidified precursor strip 284 are thicker than the second regions 282, because the first regions 268 of the patterned surface 266 have a greater depth than the second regions 270 of the patterned surface 266. However, the first regions 280 created via the patterned surface 266 have different widths between discrete sections. Likewise the second regions 282 have different widths between discrete sections. Thus, the thickness surface profile of the solidified precursor strip 284 is asymmetric and tailored to the part to be later formed.

Like in FIG. 1, the solidified precursor strip 284 in FIG. 9 can be processed in a subsequent tailor rolling station 286. Such a tailor rolling station 286 may be in the same facility as the continuous casting roller system 250 or may be in a different processing facility. If the solidified precursor strip 284 is transported to a different processing facility, it may be coiled and uncoiled and then processed in the tailor rolling station 286. The tailor rolling station 286 includes a pair of tailor rollers 288, including an upper tailor roller 290 and a lower tailor roller 292. The present disclosure contemplates use of multiple pairs of tailor rollers 288 (a train of tailor rollers), which may be conducted as either hot or cold rolling operations.

Each of the upper tailor roller 290 and lower tailor roller 292 has a patterned surface 294 including at least two regions having different thickness profiles. Like the patterned surface 266 of the pair of casting rollers 260, the patterned surface 294 includes a plurality of first regions 296 having a first depth and a plurality of second regions 298 having a second depth, which is distinct from the first depth. While only shown as first regions 96 and second regions 98, the patterned surface 294 may have many distinct regions with different profiles/depths. Notably, the patterned surface 294 of the pair of tailor rollers 288 may have the same or a similar thickness profile to the patterned surface 266 of the pair of the casting rollers 260, although the tailor roller first regions 296 and second regions 298 will have different depths than first regions 268 and second regions 270 to create a thinner precursor product 299 having the desired thickness profile as it passes by the pair of tailor rollers 288. Any of the ratios, dimensions, and features described previously above in the context of earlier embodiments applies to this variation, but is not repeated here for brevity. In certain aspects, the reduced thickness precursor product 299 strip is subsequently heat treated to modify the material properties as needed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of forming a metal alloy precursor having a tailored thickness comprising:

contacting a patterned surface of either a casting roller or a casting block with a liquid metal alloy in a continuous casting process to solidify the alloy and create a profiled strip, wherein the patterned surface includes at least a first surface region comprising a first depth and a second surface region comprising a distinct second depth and the profiled strip defines a longitudinal lengthwise axis and a lateral widthwise axis transverse to the longitudinal lengthwise axis so that the contacting creates an asymmetrical thickness profile across the lateral widthwise axis in the profiled strip, wherein a ratio of a first region having a maximum thickness ($t_{max}$) across the lateral widthwise axis to a second region having a minimum thickness ($t_{min}$) across the lateral widthwise axis is greater than or equal to about 2.3, wherein the maximum thickness ($t_{max}$) ranges from greater than or equal to about 8 mm to less than or equal to about 25 mm and the minimum thickness ($t_{min}$) ranges from greater than or equal to about 3 mm to less than or equal to about 10 mm; and cooling the profiled strip having the asymmetrical thickness profile to form the metal alloy precursor having the tailored thickness.

2. A method of forming a metal alloy precursor having a tailored thickness comprising:

contacting a patterned surface of either a casting roller or a casting block with a liquid metal alloy in a continuous casting process to solidify the alloy and create a profiled strip, wherein the patterned surface includes at least a first surface region comprising a first depth and a second surface region comprising a distinct second depth and the profiled strip defines a longitudinal lengthwise axis and a lateral widthwise axis transverse to the longitudinal lengthwise axis so that the contacting creates an asymmetrical thickness profile across the lateral widthwise axis in the profiled strip, wherein a ratio of a first region having a maximum thickness ($t_{max}$) across the lateral widthwise axis to a second region having a minimum thickness ($t_{min}$) across the lateral widthwise axis is greater than or equal to about 2.3, wherein a maximum width of the first region is greater than or equal to about 60 mm to less than or equal to about 100 mm and a maximum width of the second region is greater than or equal to about 60 mm to less than or equal to about 125 mm; and cooling the profiled strip having the asymmetrical thickness profile to form the metal alloy precursor having the tailored thickness.

3. The method of claim 2, wherein a total width of the profiled strip is greater than or equal to about 120 mm to less than or equal to about 2,000 mm and a maximum width of the first region is greater than or equal to about 60 mm to less than or equal to about 1,800 mm and a maximum width of the second region is greater than or equal to about 60 mm to less than or equal to about 1,800 mm.

4. The method of claim 2, wherein there is a plurality of first regions across the lateral widthwise axis, a plurality of second regions across the lateral widthwise axis, or both a plurality of the first regions and a plurality of the second regions across the lateral widthwise axis.

5. The method of claim 2, wherein the patterned surface further includes a third surface region comprising a third depth distinct from the first depth and the second depth and the asymmetrical thickness profile has a third region having a third thickness across the lateral widthwise axis of the strip, wherein the third thickness is greater than the minimum thickness ($t_{min}$) and less than the maximum thickness ($t_{max}$).

6. The method of claim 2, wherein the metal alloy is a high-strength low alloy (HSLA) steel.

7. The method of claim 2, wherein the ratio of the first region having the maximum thickness ($t_{max}$) across the lateral widthwise axis to the second region having the minimum thickness ($t_{min}$) across the lateral widthwise axis is greater than or equal to about 3.0.

8. A method of forming a tailored rolled blank of a metal alloy comprising:

contacting a patterned surface of either a casting roller or a casting block with a liquid metal alloy in a continuous casting process to solidify the alloy and create a profiled strip, wherein the patterned surface includes at least a first surface region comprising a first depth and a second surface region comprising a distinct second depth and the profiled strip defines a longitudinal lengthwise axis and a lateral widthwise axis transverse to the longitudinal lengthwise axis so that the contacting creates a first asymmetrical thickness profile across the lateral widthwise axis in the profiled strip, wherein a ratio of a first region having a maximum thickness ($t_{max}$) across the lateral widthwise axis to a second region having a minimum thickness ($t_{min}$) across the lateral widthwise axis is greater than or equal to about 2.3, the maximum thickness ($t_{max}$) ranges from greater than or equal to about 8 mm to less than or equal to about 25 mm and the minimum thickness ($t_{min}$) ranges from greater than or equal to about 3 mm to less than or equal to about 10 mm;

cooling the strip having the first asymmetrical thickness profile; and tailor rolling the strip between at least two tailor rollers to define a second asymmetrical thickness profile that is at least about 50% thinner than the first asymmetrical thickness profile to create a tailored rolled strip with variable thickness widthwise.

9. The method of claim 8, further comprising cutting the tailor rolled strip to form a blank comprising at least a portion of the second asymmetrical thickness profile.

10. The method of claim 8, wherein the second asymmetrical thickness profile is at least 75% thinner than the first asymmetrical thickness profile after the tailor rolling.

11. The method of claim 8, wherein a total width of the profiled strip is greater than or equal to about 120 mm to less than or equal to about 2,000 mm and a maximum width of the first region is greater than or equal to about 60 mm to less than or equal to about 1,800 mm and a maximum width of the second region is greater than or equal to about 60 mm to less than or equal to about 1,800 mm.

12. The method of claim 8, wherein a maximum width of the first region is greater than or equal to about 60 mm to less than or equal to about 100 mm and a maximum width of the second region is greater than or equal to about 60 mm to less than or equal to about 125 mm.

13. The method of claim 8, wherein the second asymmetrical thickness profile of the tailor rolled strip has a maximum thickness ($t'_{max}$) of greater than or equal to about 1.5 mm to less than or equal to about 3.5 mm and a minimum thickness ($t'_{min}$) of greater than or equal to about 0.5 mm to less than or equal to about 1.5 mm.

14. The method of claim 8, wherein there is a plurality of first regions across the lateral widthwise axis, a plurality of second regions across the lateral widthwise axis, or both a plurality of the first regions and a plurality of the second regions across the lateral widthwise axis.

15. The method of claim 8, wherein the first asymmetrical thickness profile has a third region having a third thickness across the lateral widthwise axis of the strip, wherein the third thickness is greater than the minimum thickness ($t_{min}$) and less than the maximum thickness ($t_{max}$).

16. The method of claim 8, wherein the metal alloy is a high-strength low alloy (HSLA) steel.

17. The method of claim 8, further comprising heat treating the tailor rolled strip.

18. The method of claim 8, wherein the ratio of the first region having the maximum thickness ($t_{max}$) to the second region having the minimum thickness ($t_{min}$) is greater than or equal to about 3.0.

* * * * *